US006561891B2

(12) United States Patent
Eppert, Jr. et al.

(10) Patent No.: US 6,561,891 B2
(45) Date of Patent: May 13, 2003

(54) ELIMINATING AIR POCKETS UNDER A POLISHED PAD

(75) Inventors: Stanley E. Eppert, Jr., Wilmington, DE (US); Adam Manzonie, Gilbert, AZ (US); Peter W. Freeman, Bear, DE (US); Elizabeth A. Langlois, Wilmington, DE (US)

(73) Assignee: Rodel Holdings, Inc., Wilmington, DE (US)

( * ) Notice: Subject to any disclaimer, the term of this patent is extended or adjusted under 35 U.S.C. 154(b) by 73 days.

(21) Appl. No.: 09/862,221

(22) Filed: May 22, 2001

(65) Prior Publication Data

US 2002/0002027 A1 Jan. 3, 2002

Related U.S. Application Data

(60) Provisional application No. 60/206,243, filed on May 23, 2000.

(51) Int. Cl.[7] ..... B24D 11/00

(52) U.S. Cl. ..... 451/530; 451/533; 451/285

(58) Field of Search ..... 451/41, 285, 287, 451/288, 526, 530, 533, 539

(56) References Cited

U.S. PATENT DOCUMENTS 4,927,432 A 5/1990 Budinger et al.
5,287,663 A * 2/1994 Pierce et al.
5,489,233 A 2/1996 Cook et al.
5,578,362 A 11/1996 Reinhardt et al.
5,605,760 A 2/1997 Roberts
5,900,164 A 5/1999 Budinger et al.
6,017,265 A 1/2000 Cook et al.
6,019,666 A 2/2000 Roberts et al.
6,022,264 A 2/2000 Cook et al.
6,022,268 A 2/2000 Roberts et al.
6,176,763 B1 * 1/2001 Kramer et al. ..... 451/41
6,217,426 B1 * 4/2001 Tolles et al. ..... 451/285
6,220,942 B1 * 4/2001 Tolles et al. ..... 451/65
6,287,174 B1 * 9/2001 Detzel et al. ..... 451/41

* cited by examiner

*Primary Examiner*—Eileen P. Morgan
(74) *Attorney, Agent, or Firm*—Gerald K. Kita; Blake T. Biederman

(57) ABSTRACT

A polishing pad assembly is provided that is useful for the chemical mechanical polishing of glass and electrical devices such as semiconductor wafers that comprises a polish pad and a semi-rigid base material firmly adhered to the polishing pad for positioning on a polishing platen of a polishing machine; wherein the semi-rigid base material has a modulus of rigidity of 0.01–50 GPa (GigaPascals) determined according to ASTM D 790, a thickness of 0.25–15.0 mm, and a grooved surface having a pitch of 5–100 mm and the grooves have a width of 0.025–2.5 mm and a depth of 0.1–2.5 mm.

9 Claims, 1 Drawing Sheet

ELIMINATING AIR POCKETS UNDER A POLISHED PAD

CROSS REFERENCE TO RELATED APPLICATION

This application claims the benefit U.S. Provisional Application Ser. No. 60/206,243 filed on May 23, 2000.

FIELD OF THE INVENTION

This invention relates to a polishing pad assembly that is useful for chemical-mechanical polishing (CMP) in which air bubbles or pockets of air that form between the polishing pad and a polishing platen are minimized or eliminated.

DESCRIPTION OF RELATED ART

Semiconductor wafers having integrated circuits fabricated thereon must be polished to provide a very smooth and flat wafer surface which, in some cases, may vary from a given plane by as little as a fraction of a micron. Such polishing is usually accomplished in a chemical-mechanical polishing (CMP) operation that utilizes a chemically active slurry that is buffed against the wafer surface by a polishing pad.

Typical pads used in CMP polishing are shown in the following patents: Cook et al. U.S. Pat. No. 6,022,264 issued Feb. 8, 2000; Roberts et al. U.S. Pat. No. 6,022,268 issued Feb. 8, 2000; Roberts et al. U.S. Pat. No. 6,019,666 issued Feb. 1, 2000; Cook et al. U.S. Pat. No. 6,017,265 issued Jan. 25, 2000; Budinger et al. U.S. Pat. No. 5,900,164 issued May 4, 1999; Roberts U.S. Pat. No. 5,605,760 issued Feb. 25, 1997; Reinhardt et al. U.S. Pat. No. 5,578,362 issued Nov. 26, 1996; Cook et al. U.S. Pat. No. 5,489,233 issued Feb. 6, 1996 and Budinger et al. U.S. Pat. No. 4,927,432 issued May 22, 1990.

In a typical polishing operation, the polishing pad is placed on a platen of a polishing machine and secured to the platen by a pressure sensitive adhesive (PSA) on the backside of the polishing pad. As the polishing pad is placed on the platen, bubbles of air tend to get trapped between the adhesive and the platen. This is a particular problem with large diameter pads, such as a typical 91 cm diameter pad, in which it is virtually impossible to eliminate trapped air. Any trapped air will distend the relatively thin pad material, thereby causing raised areas or bulges in the polishing surface of the polishing pad. Forcing the air bubbles out from under the pad with a roller is not effective. Instead, the pad in the area of the bulges must be manually pierced with a hand tool in order to let the trapped air escape, and then the pad material can be pressed against the platen to obtain the flattest possible polishing surface. This is a time-consuming process, and some small bulges often go undetected and remain in the polishing surface. Any bulges in the polishing surface will generate non-uniformities on the polished surface of the workpiece (i.e., a semiconductor wafer), thereby causing defects in the polished surface. Consequently, there is a need for a polishing pad or a polishing pad assembly that eliminates the entrapment of air between it and the polishing platen.

SUMMARY OF THE INVENTION

A polishing pad assembly is provided that is useful for the chemical mechanical polishing of glass and electrical devices, such as, semiconductor wafers that comprises a polish pad and a semi-rigid base material firmly adhered to the polishing pad for positioning on a polishing platen of a polishing machine; wherein the semi-rigid base material has a modulus of rigidity of 0.01–50 GPa (GigaPascals) determined according to ASTM D 790, a thickness of 0.25–15.0 mm, and a grooved surface having a pitch of 5–100 mm and the grooves have a width of 0.025–2.5 mm and a depth of 0.1–2.5 mm.

DESCRIPTION OF THE PREFERRED EMBODIMENTS

It has been found that the use of a grooved semi-rigid base material positioned between the polishing pad and the polishing platen of the polishing machine on which the pad is mounted reduces or eliminates the problem of air bubbles or pockets that form between the polishing pad and the polishing platen by allowing any entrapped air to escape via the grooves of the semi rigid base material. The larger diameter polishing pads pose more of a problem since it is almost impossible to manually remove trapped air from under these pads. Optionally, many polishing pads use a cushioning pad usually a foam backing pad that is positioned under the polishing pad and between the polishing pad and the grooved semi-rigid base material. An adhesive layer usually is positioned between the polishing pad and the cushioning pad and a second adhesive layer may be positioned between the cushioning pad and the semi rigid base material and an adhesive layer also may be positioned between the semi rigid base material and the polishing platen. The adhesive layer keeps the various layers of pad, cushioning material, and semi rigid base material from moving about during polishing when the resulting pad assembly rotates at relatively high rpm.

Figure 1:
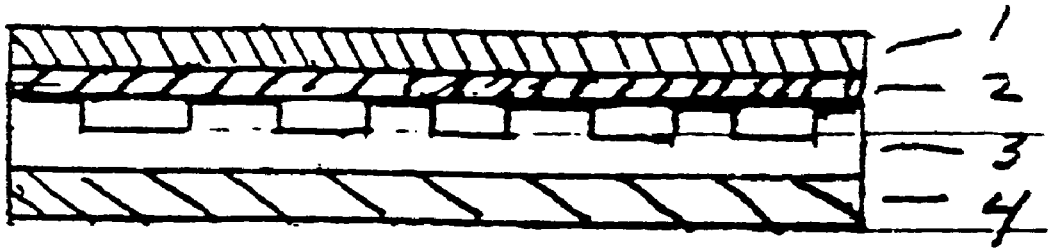
FIG. 1 shows a cross-section of a polishing pad in which the grooved semi-rigid base material is positioned between the polishing platen and the pad assembly where the grooves face the pad assembly.

FIG. 1 shows a cross section of a polishing pad 1 positioned over a cushioning pad 2 that is in turn positioned over a grooved semi rigid base material 3 that is positioned with the grooves facing upward over the polishing platen 4. A pressure sensitive adhesive (PSA) layer may positioned between the polishing pad 1 and the cushioning pad 2 and another PSA layer may be positioned between the cushioning layer 2 and the grooved semi-rigid base material 3 and still another layer of PSA may be positioned between the grooved semi-rigid base material 3 and the polishing platen 4. The grooves in the semi rigid base material allow for the escape of any air trapped during mounting of the pad on the polishing platen.

Figure 2:
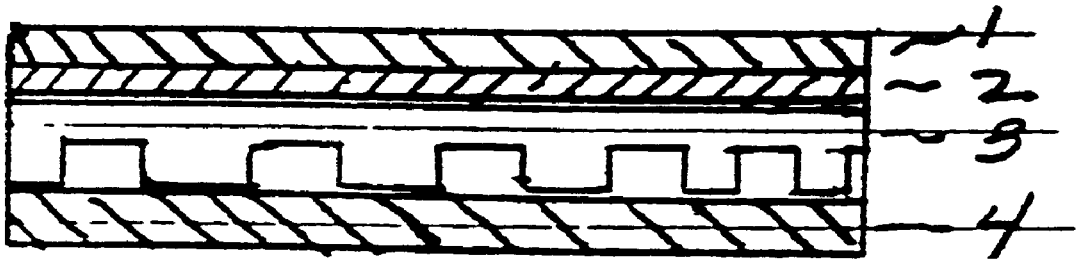
FIG. 2 shows a cross-section of a polishing pad assembly in which the grooved semi-rigid base material is adhered to the pad assembly and the grooves of the base material face the platen.

FIG. 2 shows a cross section of a polishing pad 1 positioned over a cushioning pad 2 that is in turn positioned over a grooved semi rigid base material 3 that is positioned over the polishing platen 4 with the grooves in the semi rigid base material facing downward toward the platen 4. A pressure sensitive adhesive (PSA) layer may positioned between the polishing pad 1 and the cushioning pad 2 and another PSA layer may be positioned between the cushioning layer 2 and the grooved semi-rigid base material 3 and still another layer of PSA may be positioned between the grooved semi-rigid base material 3 and the polishing platen 4. The grooves in the semi rigid base material allow for the escape of any air trapped during mounting of the pad on the polishing platen.

Figure 3:
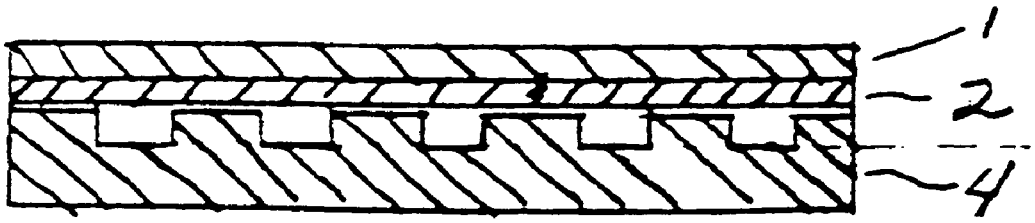
FIG. 3 shows a cross-section of a polishing pad in which the platen is grooved and the polishing pad assembly is positioned over the grooved platen.

FIG. 3 shows another embodiment of this invention and shows a cross section of a polishing pad 1 positioned over a cushioning pad 2 that is in turn positioned over a grooved polishing platen 4 with the grooves on the platen facing upward. A pressure sensitive adhesive (PSA) layer may positioned between the polishing pad 1 and the cushioning pad 2 and another PSA layer may be positioned between the cushioning layer 2 and the grooved polishing platen 4. The grooves in the polishing platen allow for the escape of any air trapped during mounting of the pad on the polishing platen.

The grooved semi rigid base material used herein has a modulus of rigidity of 0.01–50 GPa determined according to ASTM D 790. A material of this rigidity is required to provide a flat surface on which polishing pad that generally is not rigid but flexible is positioned. The rigidity of the material itself reduces the amount of air that is entrapped between the polishing pad and the rigid material. The base material has a thickness of 0.25–15.0 mm, preferably, 1–10 mm and has a grooved surface. The grooves have a pitch, i.e. distance between each groove, of 5–100 mm, preferably 10–70 mm and the grooves have a width of 0.025–2.5 mm, preferably 0.1–1.0 mm and a depth of 0.1–2.5 mm, preferably 0.3–1.5 mm.

The semi rigid base material can be a thermoplastic polymer sheet, a thermoset polymer sheet, or a fibrous polymer impregnated sheet such as fiberglass impregnated with an epoxy resin. Other materials can be used, such as, a thin sheet of a metal, such as, aluminum or stainless steel. To form the grooves in the base material, the sheet may be cast, molded or machined.

The grooves in the base material may be in a circular pattern, a linear pattern, a grid pattern, preferably the grid is formed at 90-degree angle or other angles can be used in the range of 5 up to 90 degrees.

One particularly useful semi rigid base material is an epoxy fiberglass laminate such as FR 402 manufactures and sold by Allied Signal. Grooves are cut into this material using precision matched blades and spacers which are mounted on a CNC machine.

The base material is reusable when applied directly with a PSA to polishing platen as a single layer substrate over which the polishing pad is positioned. The base material is intended for one time use when provided as a bottom substrate in a multi-layer pad construction.

Typical polishing pads that can be used in combination with the above semi rigid base pad are those that are typically used in CMP polishing, such as, IC 1000, IC 1010, IC 1400, "Politex" Pad, "Mertex" Pad manufactured and sold by Rodel Inc. of Newark, Del.

Preferably, the polishing layer of polishing pads used in this invention comprises at least one polymeric matrix. The polymeric matrix may be formed from urethanes, melamines, polyesters, polysulfones, polyvinyl acetates, fluorinated hydrocarbons, copolymers and grafts thereof, and the like, and any compatible mixtures of the aforementioned polymeric materials. One of ordinary skill in the art would understand that any other polymer having sufficient toughness and rigidity to resist abrasive wear during polishing operations may be used, in keeping with the spirit and scope of the present invention.

As presently preferred, the polymeric matrix used to form the polishing layer of the polishing pad comprises a urethane polymer. The urethane polymer is preferably formed from a polyether-based liquid urethane, such as the Adiprene™ line of products that are commercially available from Uniroyal Chemical Co., Inc. of Middlebury, Conn. The preferred liquid urethane contains about 9 to about 9.3% by weight free isocyanate. Other isocyanate bearing products and prepolymers may also be used in keeping with the spirit and scope of the present invention.

The liquid urethane is preferably one which reacts with a polyfunctional amine, diamine, triamine or polyfunctional hydroxyl compound or mixed functionality compounds, such as, hydroxyl/amines resulting in urethane/urea crosslinked networks to permit the formation of urea links and a cured/crosslinked polymer network. As presently preferred, the liquid urethane is reacted with 4,4'-methylene bis (2-chloroaniline) ("MOCA"), which is commercially available as the product CURENE® 442, from Anderson Development Co. of Adrian, Mich.

The surface of the polishing pad useful for the present invention may be provided with both macrogrooves and microgrooves that transform the solid uniform sheet into an excellent polishing pad. The polymer matrix may also be impregnated with a plurality of polymeric microelements. Suitable polymeric microelements include inorganic salts, sugars and water-soluble gums and resins. Examples of such polymeric microelements include polyvinyl alcohols, pectin, polyvinyl pyrrolidone, hydroxyethylcellulose, methylcellulose, hydropropylmethylcellulose, carboxymethylcellulose, hydroxypropylcellulose, polyacrylic acids, polyacrylamides, polyethylene glycols, polyhydroxyetheracrylites, starches, maleic acid copolymers, polyethylene oxide, polyurethanes and combinations thereof. The microelements may be chemically modified to change the solubility, swelling and other properties by branching, blocking, and crosslinking.

Optionally, many polishing pads have a cushioning pad positioned between the polishing pad and the semi-rigid base material. The cushioning pad is usually a urethane impregnated felt pad such as SUBA IV manufactured by Rodel, Inc. Newark, Del. Closed cell urethane sheet materials also can be used.

A PSA (pressure sensitive adhesive) preferably is used to adhere the various layers of the pad assembly to each other, i.e. the polishing pad to the cushioning pad, the cushioning pad to the semi rigid base material and the semi base material to the polishing platen. Typically, these PSAs are natural or synthetic rubber based adhesives or are acrylic polymer based adhesives. One suitable pressure sensitive adhesive is Controltac™ adhesive which is manufactured by 3M Company of St. Paul, Minn. The adhesive lower surface generally remains covered by a removable liner until immediately prior its application.

A suitable type of adhesive layer is a double coat adhesive layer that comprises a carrier that is positioned between oppositely facing adhesive surfaces. One of the adhesive surfaces is adhered to the polishing layer, and the other is available for adhering to the cushioning material or semi rigid base material. Another suitable type of adhesive layer is a transfer tape that is bonded to the lower surface of the polishing pad. The transfer tape has an adhesive surface that can be adhered to the base material.

Another aspect of this invention is to use a polishing platen that is grooved as shown in FIG. 3 to eliminate entrapped air. The semi-rigid base material is eliminated and the polishing pad and optional cushioning pad is positioned directly on the grooved platen. A pressure sensitive adhesive can be used to attach the polishing pad to the platen.

The invention provides a polishing pad assembly that is less susceptible to trapping air and in many instances eliminates the entrapment of air by the use a grooved semi-rigid base material or a grooved polishing platen. The grooves of the grooved surface of the polishing platen have the same parameters as those of the semi-rigid base material described above. Bulges in the polishing pad are minimized or eliminated, thereby resulting in a flat polishing surface that facilitates planarization of a workpiece (e.g., semiconductor wafer).

The following example illustrates the invention and is not meant to be restrictive in any way with respect to the present invention.

EXAMPLE

A 91 cm. diameter IC 1400 pad manufactured by Rodel Inc., Newark, Del., which is an IC 1000 pad manufactured by Rodel having a backing layer of a closed cell urethane foam sub pad, was mounted onto a standard platen of a conventional polishing machine. Air bubbles under the pad were formed during the mounting process and could not be removed using conventional means such as a pad mounting disc and could only be removed by punching a hole in the pad to release the entrapped air.

A second 91 cm diameter IC 1400 pad was mounted onto a standard platen of a polishing machine. A semi rigid base material was positioned between the pad and the polishing platen such that the grooves in the base material faced the back of the pad. This base material, which is an epoxy impregnated fiberglass, has a thickness of 1.27 mm, has machined grooves in the x and y directions at a 90 degree angles in which the grooves are 0.254 mm. wide, 0.81 mm deep and at a 25.4 mm pitch. Any entrapped air bubbles were readily removed by smoothing the pad and the pad had a very planar surface useful for polishing semiconductor devices.

A third 91 cm diameter IC 1400 pad was mounted onto a standard platen of a polishing machine. A semi rigid base material was positioned between the pad and the polishing platen such that the grooves in the base material faced the back of the pad. This base material, which is an epoxy impregnated fiberglass, has a thickness of 1.27 mm, has machined grooves in the x and y directions at a 90 degree angles in which the grooves are 0.254 mm. wide, 0.81 mm deep and at a 50.8 mm pitch. Any entrapped air bubbles were readily removed by smoothing the pad and the pad had a very planar surface useful for polishing semiconductor devices.

What is claimed:

1. A polishing pad assembly useful for the chemical mechanical polishing of glass and electrical devices comprising a polish pad and a semi-rigid base material firmly adhered to the polishing pad for positioning on a polishing platen of a polishing machine; wherein the semi-rigid base material has a modulus of rigidity of 0.01–50 GigaPascals determined according to ASTM D 790, a thickness of 0.25–15.0 mm, and a grooved surface being in contact with the polishing pad having a pitch of 5–100 mm and the grooves having a width of 0.025–2.5 mm and a depth of 0.1–2.5 mm.

2. The polishing pad assembly of claim 1 in which the semi-rigid base material is a thermoplastic polymer sheet having a grooved surface where the grooves of the surface are selected from the group consisting of a circular pattern, a linear pattern and a grid pattern where the grid is formed with angles in the range of 5–90 degrees.

3. The polishing pad assembly of claim 2 in which the semi-rigid base material is a thermoplastic polymer sheet consisting essentially of an epoxy fiberglass laminate.

4. The polishing pad assembly of claim 1 wherein the polish pad includes a foamed backing pad and the foamed backing pad is positioned between the polishing pad and the semi-rigid base material.

5. The polishing pad assembly of claim 4 wherein the polish pad includes a first and second layer of pressure sensitive adhesive and the semi-rigid base material includes a third layer of pressure sensitive adhesive and the first layer of pressure sensitive adhesive is positioned between the polishing pad and the foamed backing pad and the second layer of pressure sensitive adhesive is positioned between the backing pad and the semi-rigid base material and the third layer of pressure sensitive adhesive is positioned between the semi-rigid base material and the polishing platen.

6. The polishing pad assembly of claim 5 in which the pressure sensitive adhesive is selected from the group consisting of a natural rubber, a synthetic rubber and an acrylic polymer.

7. A process for chemical mechanical polishing of substrates which comprises placing the polishing pad assembly of claim 1 in polishing contact with a substrate and performing chemical mechanical polishing of the substrate.

8. The polishing pad assembly of claim 1 wherein the polishing platen contains the grooved surfaces.

9. The polishing pad assembly of claim 1 wherein the semi-rigid base material contains the grooved surfaces.

* * * * *

UNITED STATES PATENT AND TRADEMARK OFFICE

CERTIFICATE OF CORRECTION

PATENT NO. : 6,561,891 B2
DATED : May 13, 2003
INVENTOR(S) : Eppert Jr. et al.

It is certified that error appears in the above-identified patent and that said Letters Patent is hereby corrected as shown below:

Title page, Item [54] and Column 1, line 2,
Delete "POLISHED", insert -- POLISHING --

Column 2,
Lines 50 and 64, insert -- be -- after "may"

Column 3,
Line 11, insert -- be -- before "positioned"
Line 55, delete "Mertex", insert -- Meritex --

Signed and Sealed this

Fourteenth Day of October, 2003

JAMES E. ROGAN
*Director of the United States Patent and Trademark Office*